US005570638A

United States Patent [19]

Egli et al.

[11] Patent Number: 5,570,638

[45] Date of Patent: Nov. 5, 1996

[54] RESCUE VEHICLE FOR A CABLE RAILWAY

[75] Inventors: Ernst Egli, Hittnau; Maurice Andrey, Schwyz, both of Switzerland

[73] Assignee: Garaventa Holding AG, Goldau, Switzerland

[21] Appl. No.: 527,455

[22] Filed: Sep. 13, 1995

[30] Foreign Application Priority Data

Nov. 2, 1994 [CH] Switzerland ..... 3271/94

[51] Int. Cl.[6] ..... B61B 12/00

[52] U.S. Cl. ..... 104/173.1; 104/112; 104/128

[58] Field of Search ..... 104/173.1, 173.2, 104/183, 112, 89, 122, 128; 212/323, 98; 105/149.1, 149.2

[56] References Cited

U.S. PATENT DOCUMENTS

| | | | |
|---|---|---|---|
| 3,702,124 | 11/1972 | Highland | 104/112 |
| 3,847,085 | 11/1974 | Rypinski | 104/122 |
| 5,081,932 | 1/1992 | Hofmann | 104/173.1 |

FOREIGN PATENT DOCUMENTS

| | | | |
|---|---|---|---|
| 0399413 | 11/1990 | European Pat. Off. . | |
| 2541097 | 3/1977 | Germany . | |
| 1266773 | 10/1986 | U.S.S.R. | 104/112 |
| 1379235 | 3/1988 | U.S.S.R. | 104/122 |
| 2267472 | 12/1993 | United Kingdom | 104/112 |

OTHER PUBLICATIONS

Internationalen Seilbahnrundschau (International Cable Railway Review) Aug. 1992, pp. 24–25.

*Primary Examiner*—Mark T. Le

*Attorney, Agent, or Firm*—Sughrue, Mion, Zinn, Macpeak & Seas

[57] ABSTRACT

A rescue vehicle 1 for a cable railway is conveyed above the passenger cars $\mathbf{2}_B$, $\mathbf{2}_T$ on cable 4 in the direction of travel F. Its cabin 3 is hung on suspension tackle 5 which rides on the cable 4, and which can swing in the manner of a pendulum ($\mathbf{5}_1$). The rescue cabin 3 can be released from the suspension tackle 5 and lowered on at least three triangulated hoisting cables (6) to a rescue position at the level of a stranded passenger car $\mathbf{2}_B$ in order to pick up its passengers. A cable winch 7 with a single shaft and winches is mounted on the roof of the cabin, to synchronously wind in and pay out the hoisting cables.

11 Claims, 10 Drawing Sheets

RESCUE VEHICLE FOR A CABLE RAILWAY

BACKGROUND OF THE INVENTION

This invention relates to a rescue vehicle for the passenger cars of a continuous cable railway, which can be conveyed to a position above a passenger car on at least one cable, with suspension tackle attached to the cable and with a rescue cabin which is attached tightly on the suspension tackle in a driving position.

According to international standards, cable railways are to be equipped with a rescue vehicle for emergency cases, for example a derailing of the cable from the track, in order to retrieve the passengers from the blocked transport car when country is being crossed that is difficult to traverse over, and from which they cannot be removed from the cable. Thanks to the high degree of operational safety generally achieved by cable railways today, the rescue vehicle equipment is little used since such emergencies do not generally occur. The rescue vehicles, however, must always be prepared and available for use in emergencies according to the regulations, and the testing of the vehicles is prescribed once yearly, during which their readiness for use and functional capability is determined and inspected.

For a rescue vehicle with the features noted above, as disclosed in EP 399 413, the rescue cabin which is fixed on the suspension tackle so that it cannot be removed has a holding capacity which is as large as a cabin of the passenger cars. On the cabin of the rescue vehicle, an additional rescue unit is attached on both sides, the rescue basket of which can be lowered by winch-driven hoisting cables to each passenger car. Each rescue basket offers standing surfaces for two people, has a platform which can be swivelled between a folded up driving position and a folded down position for walking in a rescue operation, and allows itself to be secured for boarding at each passenger car as well as at the rescue vehicle.

With this known rescue vehicle, several rescue operations are necessary to pick up all of the passengers of each passenger car in the rescue vehicle; moreover, the vehicles must be secured to one another twice for each rescue process for transferring passengers, namely the basket of the rescue unit to the passenger car for one and for another on the cabin of the rescue vehicle.

In a variation published in the Internationalen Seilbahnrundschau (International Cable Railway Review) 8/1992, pages 24–25, the known rescue vehicle has a diesel motor-driven hydrostatic driver, has only one rescue unit, and is like a crane with a hand crank over a worm gear pair rotatable by 90° on the suspension tackle in each case. This shortens the distance between the two drive tracks to each passenger car; the rescue basket holding two persons can be lowered with a gas-driven motor to the height of the vehicle.

SUMMARY OF THE INVENTION

In contrast to this, the problem to be solved is to make a quicker transfer of all of the passengers of each passenger car to the rescue vehicle possible. This problem is solved for a rescue vehicle in accordance with the invention, wherein the rescue cabin can be released, lowered or hoisted again to and from the suspension tackle with a suspension comprising at least three synchronously driven hoisting cables, out of the drive position and into a rescue position for the passenger car.

The rescue vehicle is conveyed in its drive position above the passenger car; the drive track for the rescue vehicle can comprise a carrying cable, on which it is conveyed with a running gear, or two carrying cables and have a separate traction cable, or two of these. The traction cable for the rescue vehicle can be wound on a cable winch, or be run continuously. The drive track of the rescue vehicle can also serve as the drive track of the passenger car at the same time, for instance in the case of a pendulum cable railway; however, a single drive track only for the rescue vehicle can be arranged between both drive tracks for the transport vehicles, for instance in the case of a continuous cable railway.

The carrying cable for the rescue vehicle can also be the traction cable at the same time, on which it is attached so that it can swivel; in this case, the carrying cable is in continual operation and it is in turn a drive track only for the rescue vehicle arranged above and between the two drive tracks of the passenger cars; two carrying traction cables can also be provided.

In the drive position, in which the rescue vehicle is conveyed to the blocked passenger car, the rescue cabin is stopped fast on the suspension tackle. At the passenger car, the rescue vehicle is released from the suspension tackle and lowered on at least three synchronously windable and unwindable hoisting cables to its rescue position. This suspension of the rescue cabin from the suspension tackle is statically set and its center of gravity is stable within the suspension area. Four hoisting cables can also be arranged, one on each corner of the rescue vehicle.

In the case of a continuous cable railway, the transport capacity of the rescue vehicle is preferably set for half of the one passenger car, but can also basically correspond to the total transport capacity of a passenger car. In addition, the rescue vehicle can bear two helpers. Preferably, the cable winch drive is arranged above the rescue cabin on an intermediate frame fixed to the cabin. In this way, the cable winch drive is accessible to the helpers when the rescue cabin is released from the suspension tackle.

In an advantageous furtherance of the invention, a cable winch drive is provided with a winch shaft positioned on the intermediate frame and at least three winches attached on the winch shaft so they do not twist, with which as many hoisting cables suspend the rescue cabins on their corner points on turnabout rollers. Through opposing winding of the corresponding cables, the forward and reverse winding of the cables at the same time is provided by turning the shaft. In another configuration of the invention, the suspension comprises three hoisting cables, the winch shaft is positioned on the end of one side on the roof of the rescue cabin, and only the hoisting cable of the middle winch is deflected over an associated turnabout roller on the opposite third corner point on the roof of the rescue cabin; the hoisting cables of both outer winches engage directly in the associated winch in each case.

BRIEF DESCRIPTION OF THE DRAWINGS

FIG. 2(*b*) is a top view along the line IIb—IIb in FIG. 2(*a*);

FIG. 2(*c*) shows a variation of the cable winch drive;

FIG. 3(*b*) is a top view of FIG. 3(*a*);

FIG. 4(*b*) shows a side view of FIG. 4(*a*);

FIG. 6(*b*) shows a side view of FIG. 6(*a*).

DETAILED DESCRIPTION OF THE PREFERRED EMBODIMENTS

Figure 1:
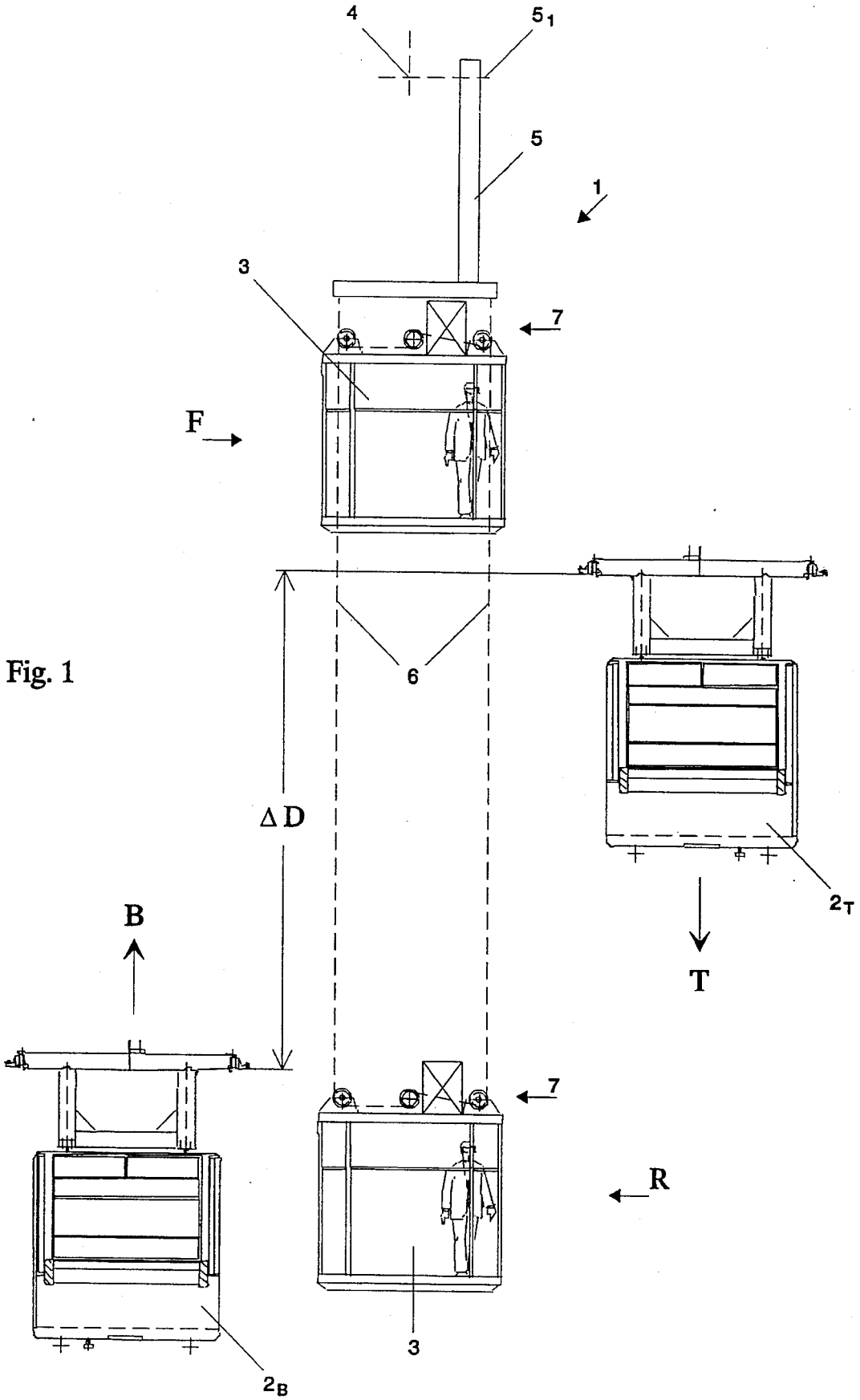
FIG. 1 shows a rescue vehicle conveyed on a rescue track in accordance with the invention, between the two drive tracks for the passenger cars.

A DMC (duo mono cable) continuous cable railway has two carrying traction or conveying cables strung in parallel at the same height in the area of their conveying range in the direction of a mountain (in the direction of arrow B) or in the direction of a valley (in the direction of arrow T) in accordance with FIG. 1. Every two synchronous conveying cables form a mountain track B or a valley track T over the width of the vehicle, on which passenger cars are suspended with cable clamps which can be decoupled at the terminal stations. The passenger car conveyed in the direction of the mountain is referenced $2_B$; the passenger car conveyed in the direction of the valley is $2_T$. Due to the different loads of the transport vehicles $2_B$ or $2_T$ which are conveyed in the direction of the valley over cable supports that are not depicted, different slack occurs in the area between the supports when the passenger cars $2_B$ or $2_T$ drive by one another, for instance the slack ΔD depicted in FIG. 1 on the conveying cable of the mountain track B or the valley track T. In the middle, between the mountain and the valley tracks of the passenger cars, there is the rescue cable 4 of a rescue track, which conveys a rescue vehicle 1, above the drive tracks B or T of the passenger cars.

The rescue vehicle 1 comprises a suspension tackle 5 pivotally attached at $5_1$ on the rescue cable 4 and a rescue cabin 3, the transport capacity of which is suited to that of the passenger cars, in addition to room for two helpers. Between the suspension tackle 5 and the rescue cabin 3, a cable winch drive 7 is fixed to the roof of the rescue cabin 3, with which the cabin 3 along with the winch drive 7 can be released from its drive position F in which it is arrested on the suspension tackle 5, and lowered from the suspension tackle 5 on three hoisting cables 6 into a rescue position R suitable to the height of the passenger car $2_B$(or $2_T$).

Figure 2A:
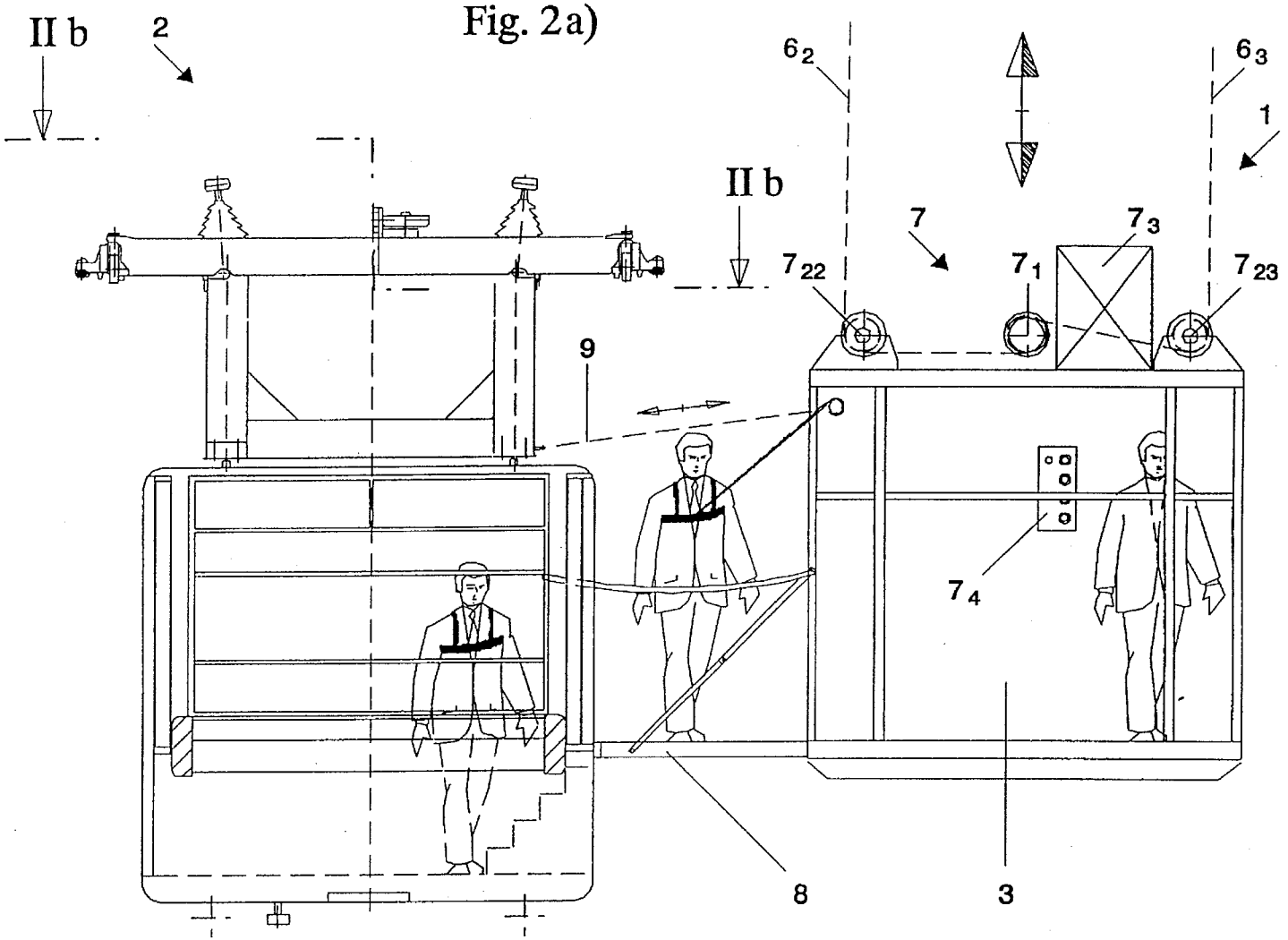
FIG. 2(*a*) shows a front view of a rescue process with a lowered rescue cabin which is also secured on the passenger car.
Figure 2B:
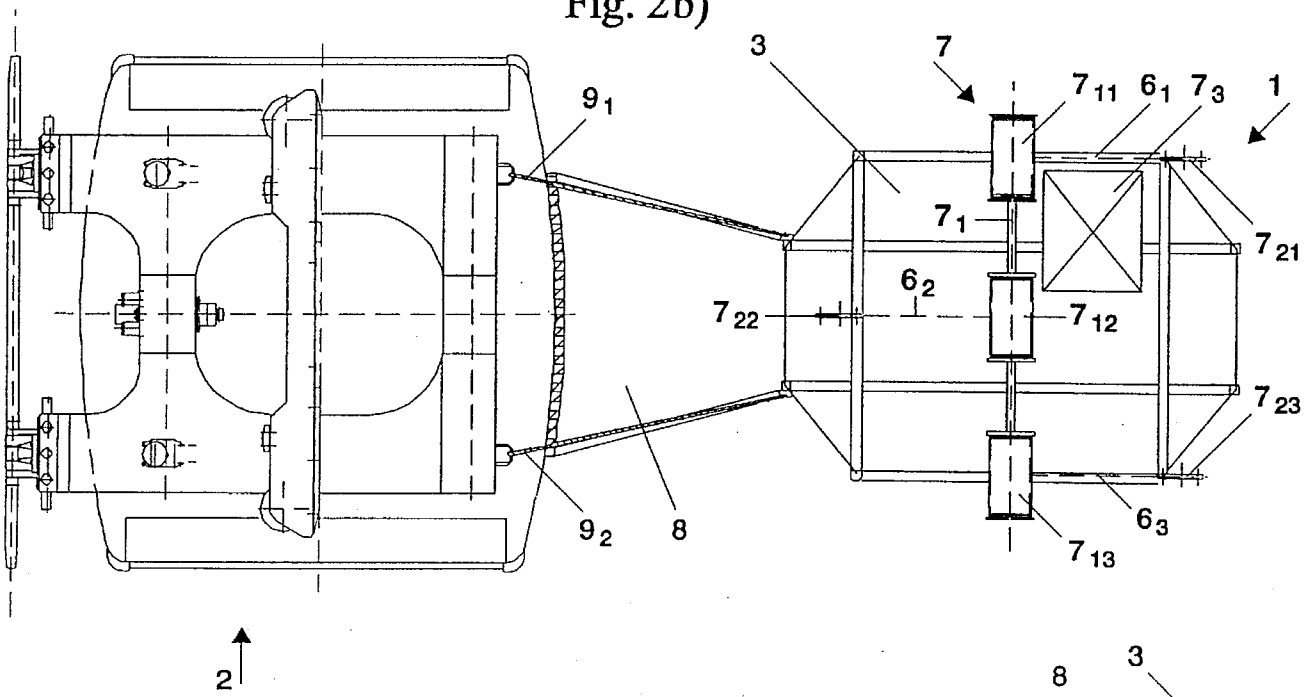
Figure 2C:
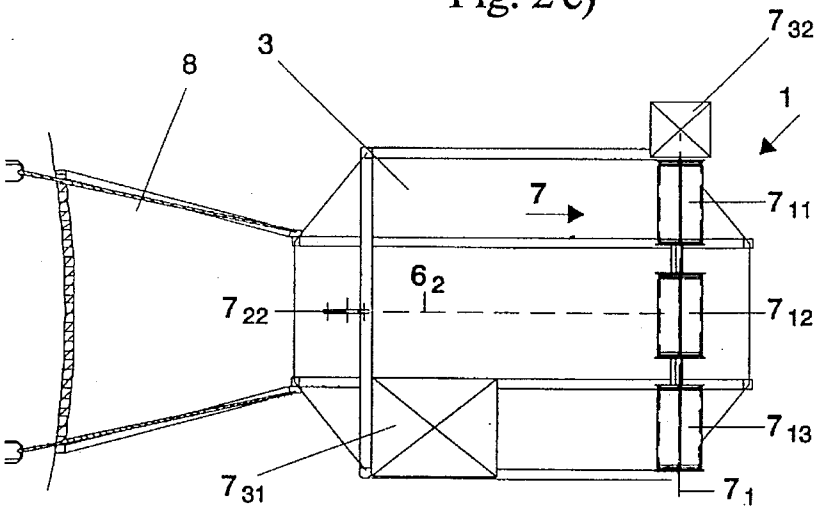

The cable winch drive 7 is located in accordance with FIGS. 2(*a*) and 2(*b*) on the roof of the rescue cabin 3. Three cable winches $7_{11}$, $7_{12}$ and $7_{13}$ are fixed on a common winch shaft $7_1$; the winch shaft $7_1$ is oriented in the direction of travel and positioned in the middle on the roof of the rescue cabin 3. On each winch $7_{11}$ to $7_{13}$ one of three hoisting cables $6_1$ to $6_3$ is wound; the middle winch $7_{12}$ is wound opposite to the two front and back winches $7_{11}$ and $7_{13}$ in the direction of travel. In each rotational direction of the winch shaft $7_1$, the three hoisting cables $6_1$ to $6_3$ can thus be wound or unwound synchronously. A turnabout roller for deflecting from the horizontal to the vertical is allocated to each hoisting cable $6_1$, $6_2$ and $6_3$. Two turnabout rollers $7_{21}$or $7_{23}$ are mounted on side corners of the rescue cabin 3; the third turnabout roller $7_{22}$ is mounted on the other side in the middle on the roof of the cabin. The three turnabout rollers establish a statically set three-point suspension for the rescue cabin 3, with the center of gravity in the "triangular" suspension area. A schematically depicted drive unit $7_3$ comprises a diesel motor with hydraulic power transmission for the winch shaft $7_1$, including a hydraulic motor and a hydraulic pump. The cable winch drive 7 is controlled by a control unit $7_4$ in the interior of the rescue cabin.

In the variation of the cable winch drive 7 depicted in FIG. 2(*c*), the winch shaft is positioned on one side of the rescue cabin 3 on the roof, the middle hoisting cable $6_2$ is deflected to the vertical on the other side of the rescue cabin 3 with a turnabout roller $7_{22}$, and the other two hoisting cables ($6_1$ and $6_3$ in FIG. 2(*b*)) engage directly on their associated winches $7_{11}$ and $7_{13}$, so that the two turnabout rollers $7_{21}$ and $7_{23}$ depicted in FIG. 2(*b*) are unnecessary. A hydrostatic drive is provided once again; the drive unit including the hydraulic pump is depicted and referenced with $7_{31}$, and the hydromotor mounted on the winch shaft $7_1$, including a reduction gear, is depicted and referenced with $7_{32}$.

Figure 3A:
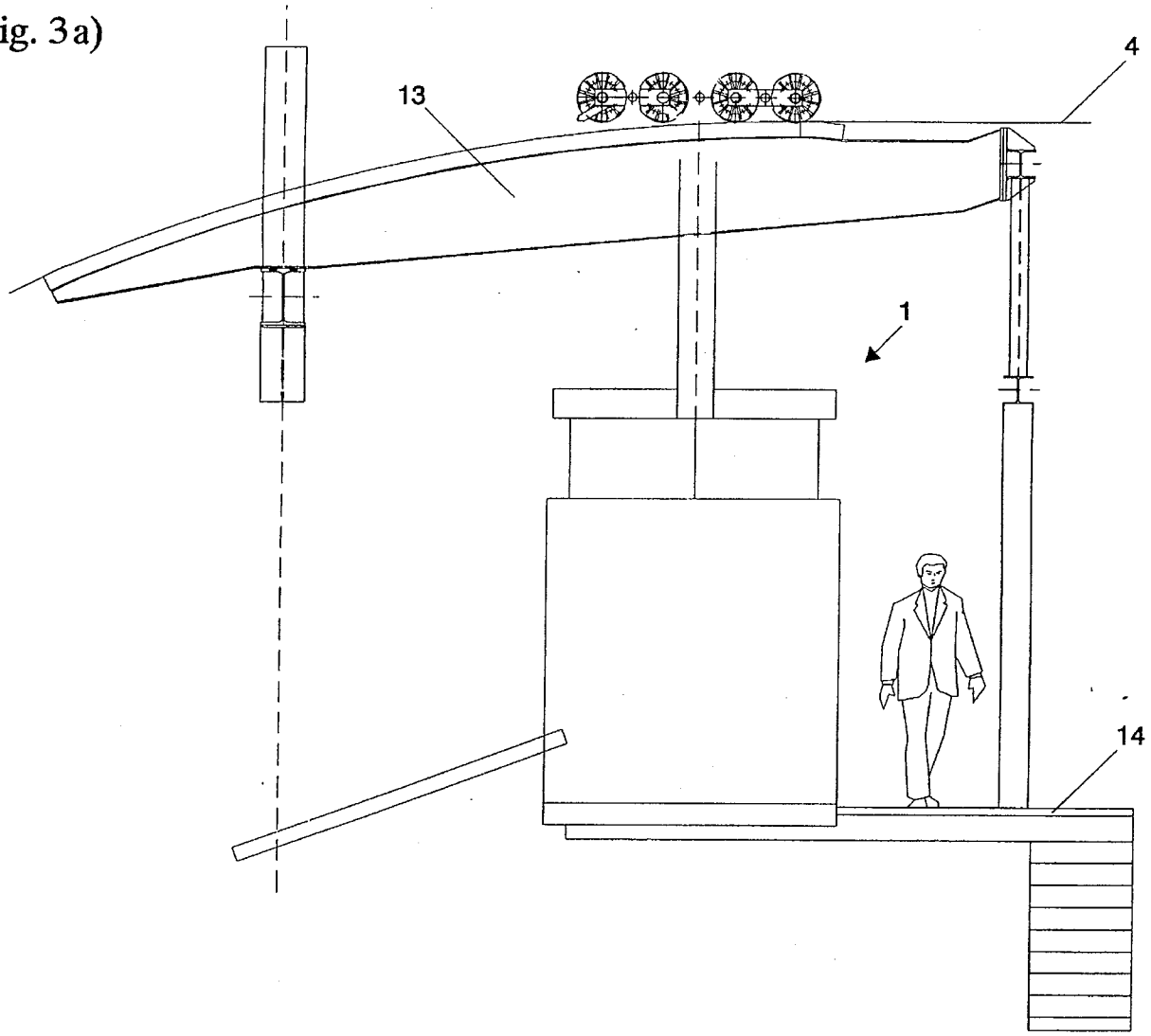
FIG. 3(*a*) is a side view of the mountain station of a cable railway with the rescue vehicle side tracked there on the cable saddle ready for use.
Figure 3B:
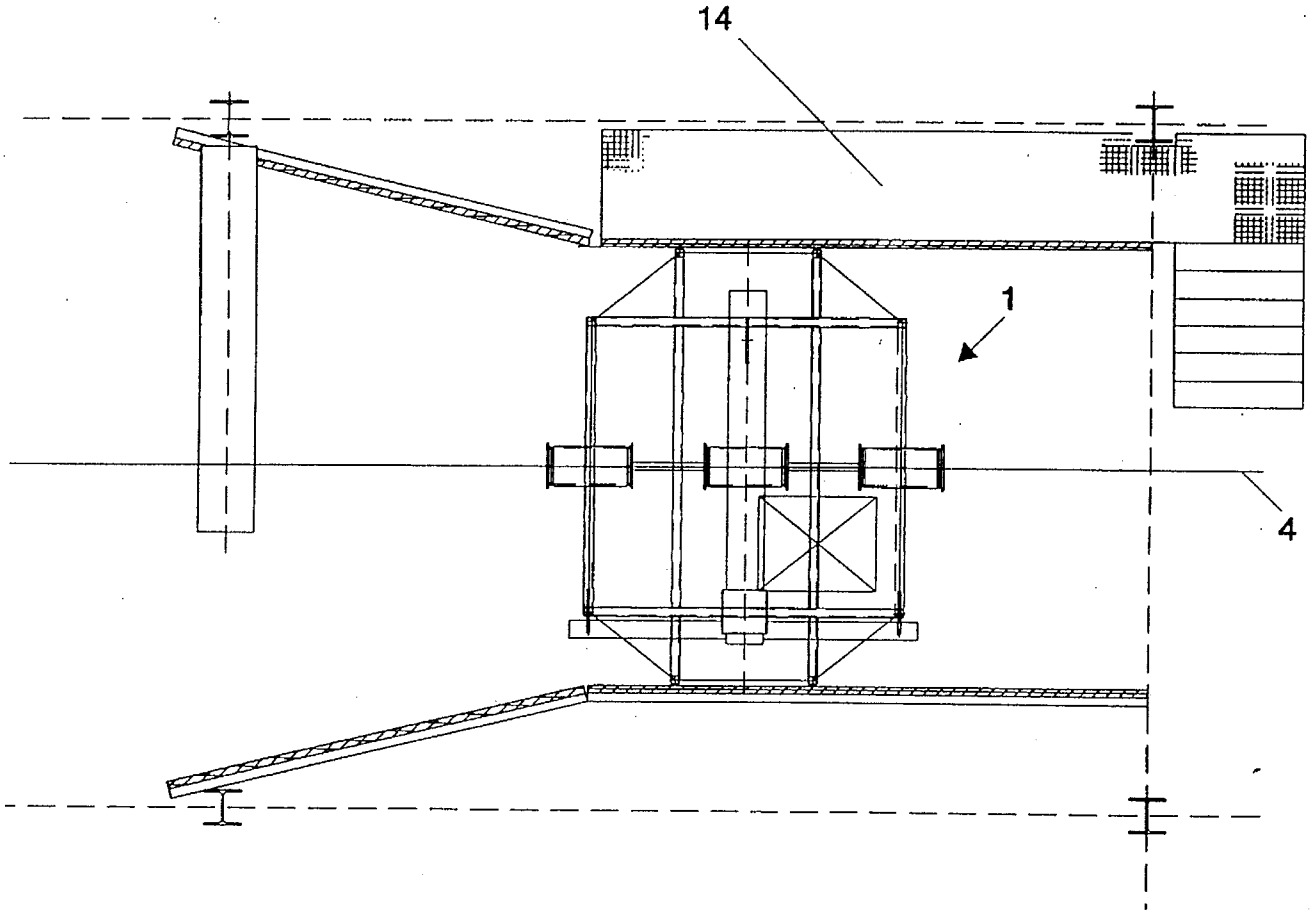

For a rescue process, the rescue vehicle 1 on the rescue cable 4 is conveyed in the direction of travel F over the stranded passenger car, and the rescue cabin 3, as will be explained in more detail below, is released from the suspension tackle and lowered with the control unit $7_4$ into the rescue position R, that is to say, lowered to the required height relative to the passenger car $2_B$, in order to transfer the passengers found there. The rescue cabin 3 has a hinged platform 8 on both sides, and is secured with two cables $9_1$ and $9_2$ to the suspension tackle of the passenger car, after which all of the passengers can transfer. After a successful rescue operation, the cabin 3 is raised with the control unit $7_4$ again into the drive position F in which it abuts against the suspension tackle 5, is locked there, and then conveyed into the mountain station of the cable railway as depicted in FIG. 3 (or into the valley station if nearer), where the passengers exit the rescue vehicle 1 above the station platform (not shown) on a landing 14 and step down to the station platform. In the roof garret of the mountain station, the rescue vehicle 1 remains sidetracked suspended on the cable saddle 13 largely unnoticed, and is available for use at all times.

Figure 4A:
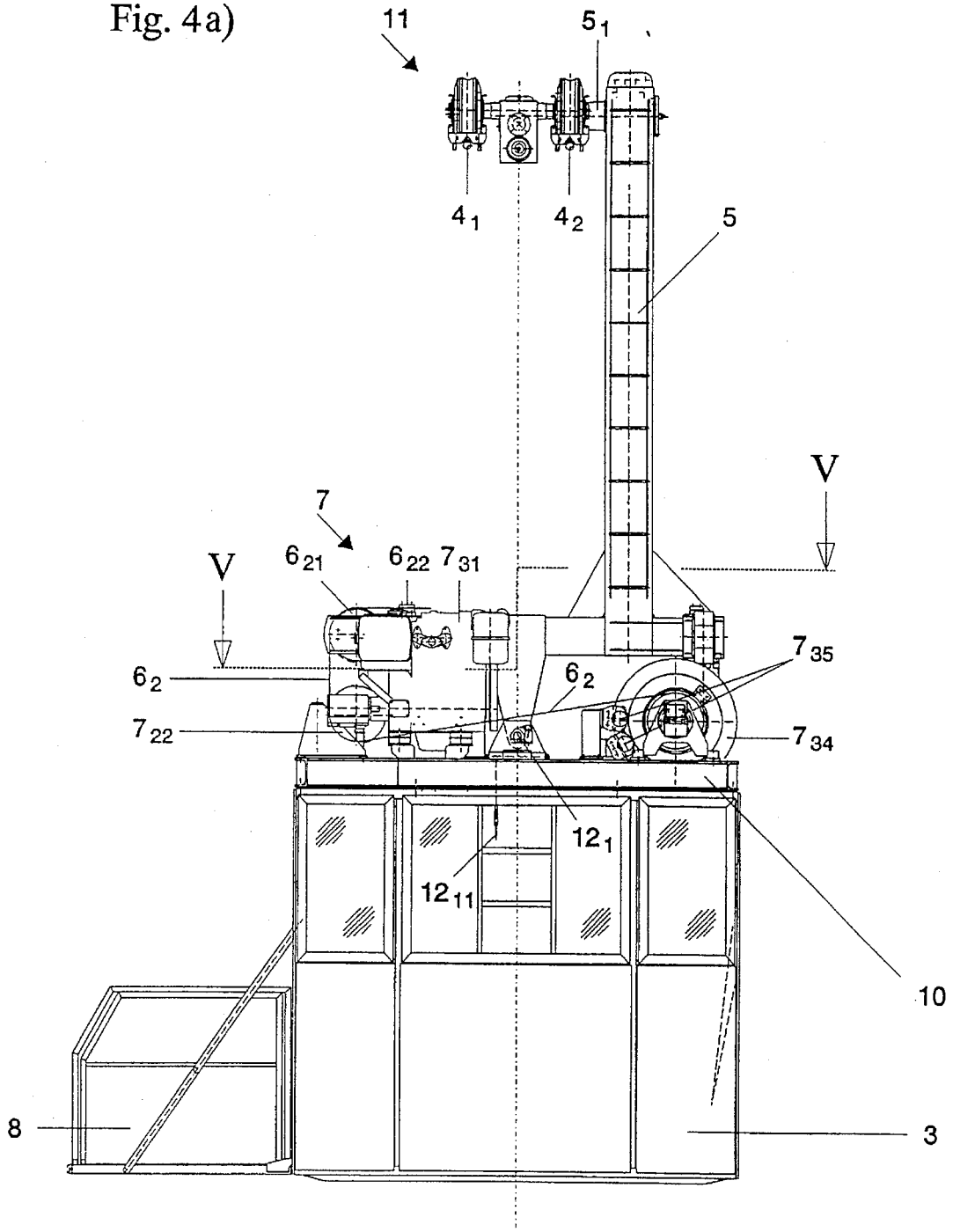
FIG. 4(*a*) shows a front view of the variation of the rescue vehicle in accordance with FIG. 2(*c*)
Figure 4B:
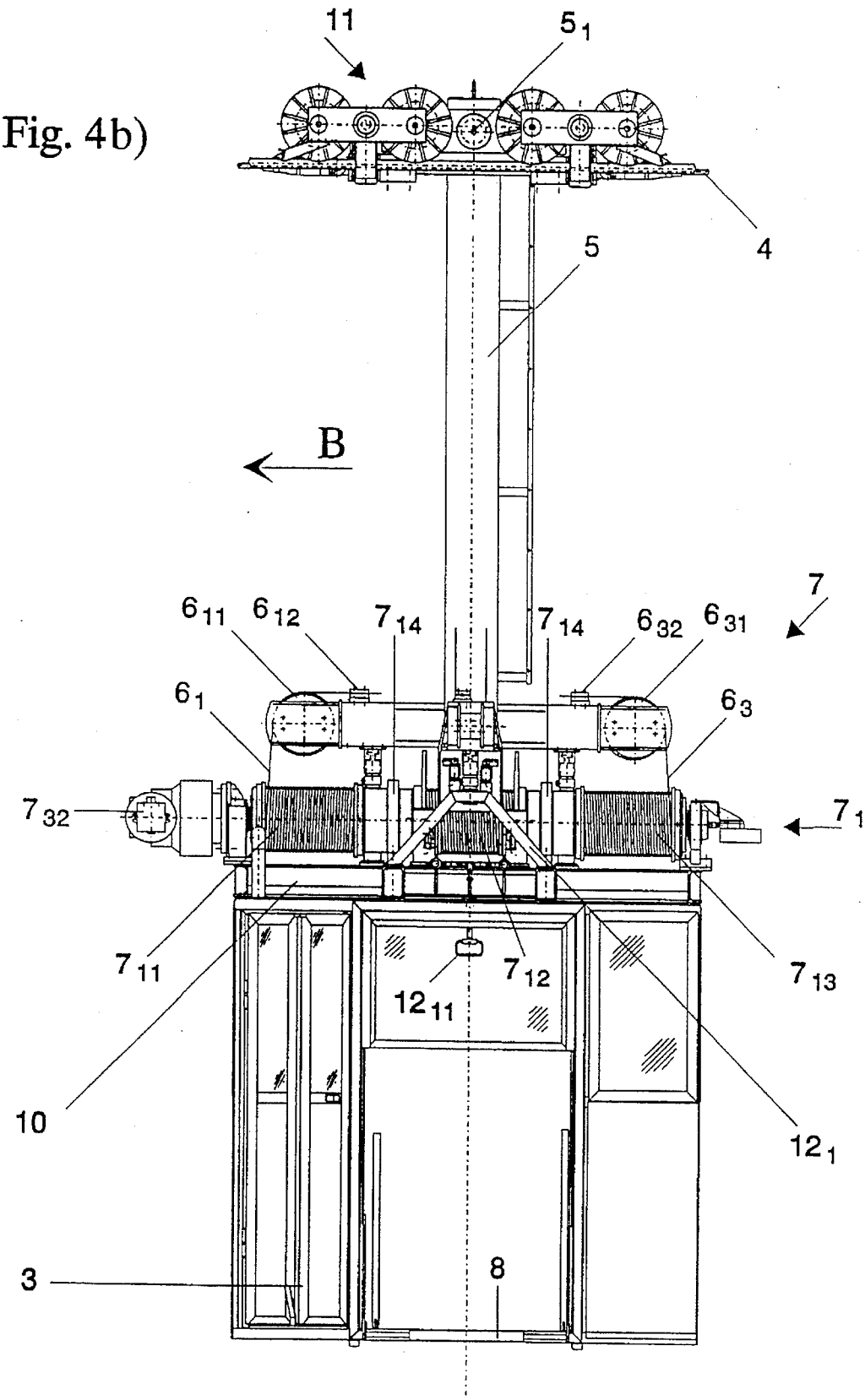
Figure 5:
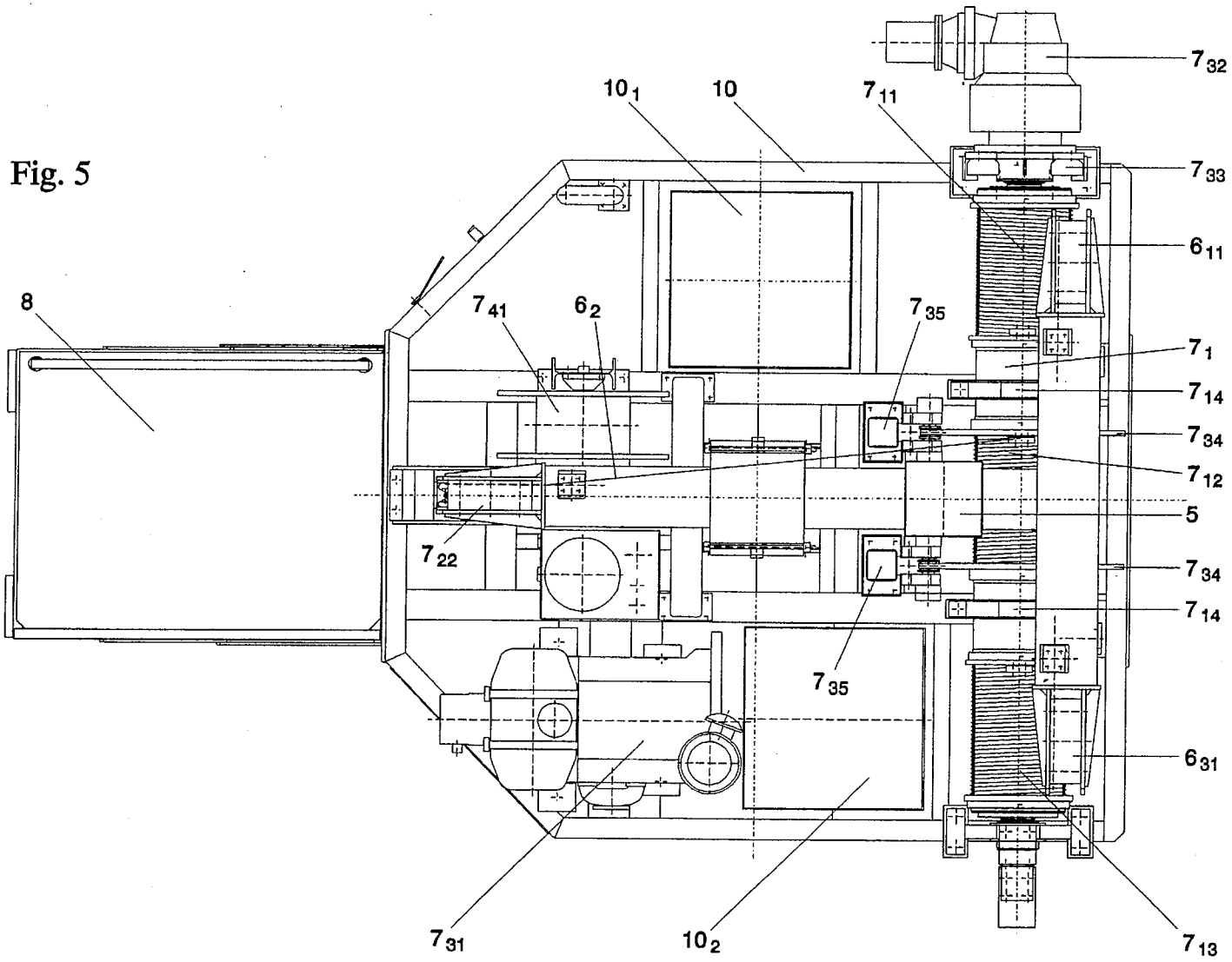
FIG. 5 shows an enlarged, detailed top view along line V—V in FIG. 4(*a*)

A preferred embodiment of the rescue vehicle 1 is depicted in detail in FIGS. 4(*a*), 4(*b*) and 5. The rescue vehicle is conveyed with an eight-wheeled running gear 11 on two carrying cables $4_1$ and $4_2$. The running gear 11 holds the suspension tackle 5 in the joint $5_1$ in pendulum fashion; the rescue cabin 3 including the cable winch drive 7 is hung from the suspension tackle 5. The rescue cabin is fixed to an intermediate frame 10, on which the cable winch drive 7 is mounted. The winch shaft $7_1$ is disposed on an end side of the cabin 3, with the driving hydromotor $7_{32}$ oriented in the direction of travel B and the shaft journaled in two shaft bearings $7_{14}$. The hoisting cable $6_2$ of the middle winch $7_{12}$ is wound opposite to the two outer winches $7_{11}$ or $7_{13}$ and deflected to the vertical in the middle of the opposite end side of the cabin 3 with the turnabout roller $7_{22}$; the two other hoisting cables $6_1$ and $6_3$ engage directly in the associated winches $7_{11}$ and $7_{13}$. The ends of the three hoisting cables $6_1$, $6_2$, $6_3$ are attached to the suspension tackle by looping around three suspended cable disks $6_{11}$, $6_{21}$, $6_{31}$ several times, and are clamped to the suspension tackle 5 in end attachments $6_{12}$, $6_{22}$ and $6_{32}$.

The winch shaft $7_1$ is driven by a hydrostatic driver $7_3$. The diesel unit with the hydraulic motor is referenced with $7_{31}$ and hydraulically connected with a pump unit $7_{32}$. In the pump unit $7_{32}$, a reduction gear and an operational brake $7_{33}$ are integrated. Two brake disks $7_{34}$ are securely mounted on the winch shaft, and can each be braked by two caliper pads $7_{35}$. The cable of the control unit $7_4$ is wound on a spring reel $7_{41}$. Finally, entrances and exits $10_1$ and $10_2$ are provided for the helpers in the intermediate frame 10 on both sides.

Figure 6A:
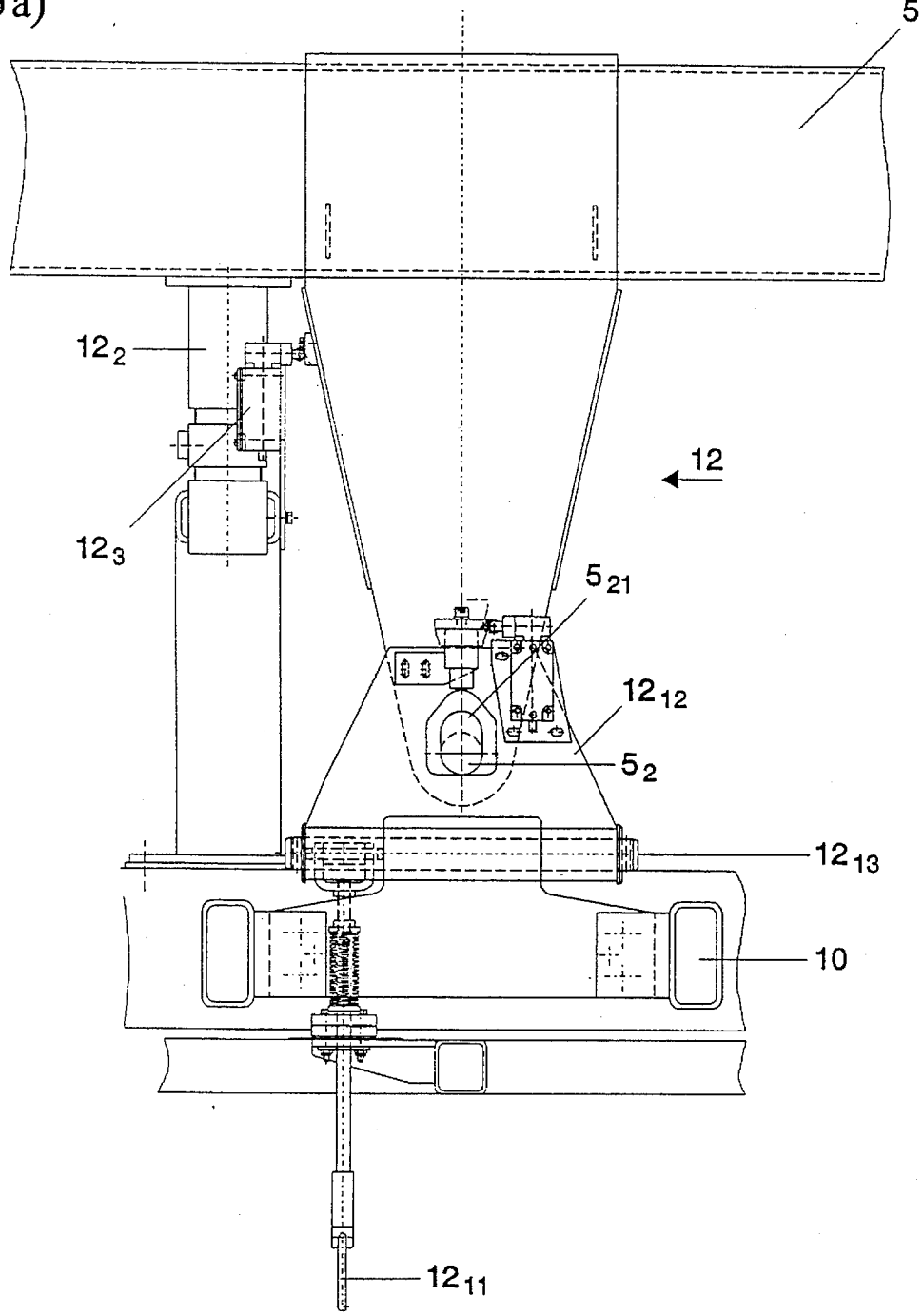
FIG. 6(*a*) shows a front view of the arresting of the rescue cabin on the suspension tackle.
Figure 6:
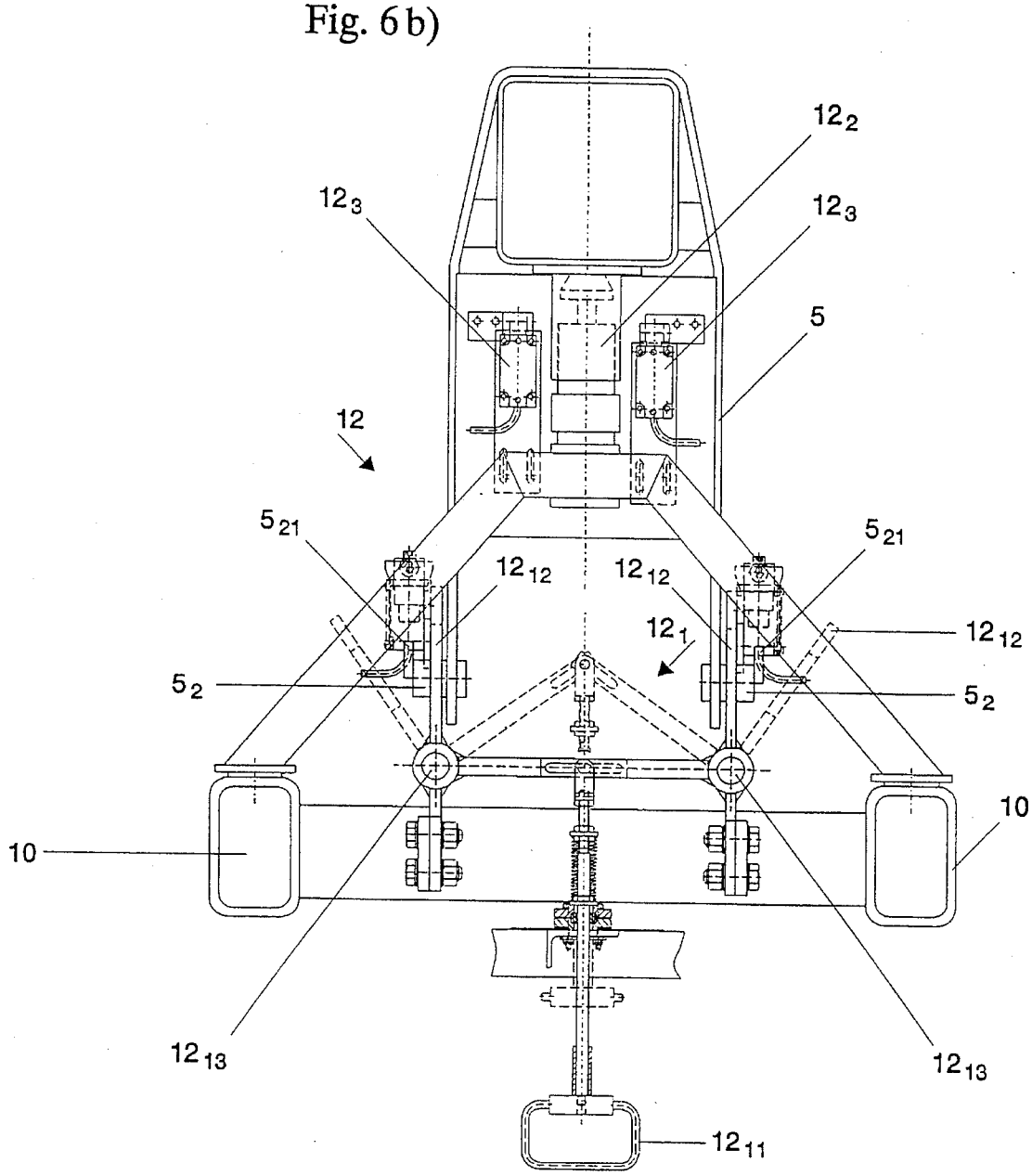

The rescue cabin 3 can be locked or arrested by a latch 12 on the suspension tackle 5; in the interior of the cabin a handle $12_{11}$ of a lever rod $12_1$ is situated, with which it can be clamped on the suspension tackle as indicated in detail in FIGS. 6(*a*) and 6(*b*). When lifting, the rescue cabin 3 is driven toward two suspended end switches $12_3$, which disconnect the cable winch drive 7. The handle $12_{11}$ engages with the end of a rod in slots on two latches $12_{12}$ disposed in a knee lever device (depicted with dotted lines on the intermediate frame 10 such that it can swivel and pull the lever to latch it in its extended position (shown with broken line). For this, the two latches $12_{12}$ overlap the collar $5_{21}$ from each of the suspended pins $5_2$, and interlock on the two pins $5_2$ after lowering the cabin 3. The rescue cabin is still supported by three adjustable absorption buffers $12_2$ attached to the intermediate frame at three points on the suspension tackle 5, which allow low relative swinging movement between the rescue cabin 3 and the suspension tackle 5 in the direction of travel F.

We claim:

1. A rescue vehicle (1) for passenger cars (2) of a continuous cable railway, including:

a) a discrete rescue cabin (3) which can be conveyed on at least one rescue cable (4) in a driving position (F) above the passenger cars, b) suspension tackle (5) riding in pendulum fashion on the rescue cable and coupled to the rescue cabin by at least three triangulated hoisting cables (6), and c) a cable winch drive (7) for synchronously paying out and winding in the hoisting cables to lower the entire rescue cabin to a position alongside a stranded passenger car for the direct transfer of passengers therein, and to thereafter raise the cabin into abutment with the suspension tackle for conveyance to an end terminal.

2. A rescue vehicle as in claim 1, wherein the cable winch drive is rigidly mounted on an intermediate frame (10) secured on top of the rescue vehicle cabin.

3. A rescue vehicle as in claim 2, wherein the cable winch drive has a winch shaft ($7_1$) journalled on the intermediate frame, and at least three winches ($7_{11}$ to $7_{13}$) coupled to the shaft and individually wound with said hoisting cables ($6_1$ to $6_3$) to suspend the rescue cabin on triangulated turnabout rollers ($7_{21}$ to $7_{23}$).

4. A rescue vehicle according to claim 3, wherein said winch shaft ($7_1$) is driven by a hydrostatic driver ($7_3$), and wherein entrances and exits ($10_1$, $10_2$) for personnel are provided in the intermediate frame (10) on opposite sides thereof.

5. A rescue vehicle according to claim 2, wherein said suspension tackle (5) has a latch (12) for locking the rescue cabin, said latch (12) being operable by a lever rod ($12_1$) connected to a handle ($12_{11}$) situated in an interior of the cabin, and wherein the rescue cabin is supported by three adjustable absorption buffers ($12_2$) attached to said intermediate frame (10) on the suspension tackle (5).

6. A rescue vehicle as in claim 1, comprising three hoisting cables ($6_1$ to $6_3$), and a winch shaft ($7_1$) disposed at one side of a roof of the rescue cabin, one said hoisting cable ($6_2$) of a middle winch ($7_{12}$) deflected over an associated turnabout roller ($7_{22}$) on an opposite side of the rescue cabin roof, and two said hoisting cables ($6_1$, $6_3$) wound directly on end winches ($7_{11}$, $7_{13}$) on said one side of the rescue cabin roof.

7. A rescue vehicle according to claim 1, wherein the suspension tackle includes an eight-wheeled running gear (11) for conveying the rescue vehicle on the rescue cable, wherein the hoisting cables ($6_2$, $6_2$, $6_3$) have ends attached to said suspension tackle (5) by loops extending around three suspended cable disks ($6_{11}$, $6_{21}$, $6_{31}$) several times, and wherein said ends of the hoisting cables are each clamped to the suspension tackle in end attachments ($6_{12}$, $6_{22}$, $6_{32}$).

8. In a cable car system for conveying passengers between two spaced points, including at least one support cable extending between the points, a passenger car suspended from the cable, and drive means for moving the car thereon, a rescue apparatus, comprising:

a) a rescue cable suspended above the support cable and laterally thereof, b) suspension means slidably and driveably depending from said rescue cable, c) a discrete rescue cab moveably coupled to and depending from the suspension means, and d) traction means controllable from the rescue cab for lowering the entire cab from a transport whereat said cab vertically abuts the suspension means to a rescue position horizontally adjacent a stranded passenger car for the direct transfer of passengers therein, and for raising said cab back up to the transport position, e) wherein the rescue cab is coupled to the suspension means by at least three triangulated hoisting cables, and the traction means includes winch means for synchronously winding in and paying out said triangulated hoisting cables.

9. A cable car system according to claim 8, wherein the traction means is rigidly mounted on an intermediate frame secured on top of the rescue cab.

10. A rescue vehicle as in claim 9, wherein the traction means has a winch shaft ($7_1$) journalled on the intermediate frame, and at least three winches ($7_{11}$ to $7_{13}$) coupled to the shaft and individually wound with said triangulated cables ($6_1$ to $6_3$) to suspend the rescue cab on turnabout rollers ($7_{21}$ to $7_{23}$).

11. A rescue vehicle as in claim 9, wherein the winch means comprises a winch shaft ($7_1$) disposed at one side of the rescue cab top, one of said hoisting cables ($6_2$) of a middle winch ($7_{22}$) being deflected over an associated turnabout roller ($7_{22}$) on an opposite side of the rescue cab top, and two of said hoisting cables ($6_1$, $6_3$) being wound directly on end winches ($7_{11}$, $7_{13}$) on said one side of the rescue cab top.

* * * * *